US012150532B2

(12) United States Patent
Aichinger

(10) Patent No.: US 12,150,532 B2
(45) Date of Patent: Nov. 26, 2024

(54) DEVICE FOR PROTECTING AN ARTICLE FROM MOISTURE

(71) Applicant: Jürgen Aichinger, Sierning (AT)

(72) Inventor: Jürgen Aichinger, Sierning (AT)

( * ) Notice: Subject to any disclaimer, the term of this patent is extended or adjusted under 35 U.S.C. 154(b) by 14 days.

(21) Appl. No.: 17/434,174

(22) PCT Filed: Feb. 27, 2020

(86) PCT No.: PCT/IB2020/051680

§ 371 (c)(1),
(2) Date: Aug. 26, 2021

(87) PCT Pub. No.: WO2020/174434

PCT Pub. Date: Sep. 3, 2020

(65) Prior Publication Data

US 2022/0142317 A1 May 12, 2022

(30) Foreign Application Priority Data

Feb. 28, 2019 (EP) ..... 19020098

(51) Int. Cl.
*A45C 11/22* (2006.01)
*A45C 3/10* (2006.01)
*A45C 11/00* (2006.01)

(52) U.S. Cl.
CPC ..... *A45C 11/22* (2013.01); *A45C 3/10* (2013.01); *A45C 2011/002* (2013.01); *A45C 2011/003* (2013.01)

(58) Field of Classification Search
CPC . A45C 11/22; A45C 13/008; A45C 2011/002; A45C 2011/003; A45C 3/10
USPC ..... 224/676
See application file for complete search history.

(56) References Cited

U.S. PATENT DOCUMENTS 1,884,328 A * 10/1932 Sperling ..... A45C 1/04 24/DIG. 43
2,036,687 A * 4/1936 Fisher ..... A45C 11/22 53/449
4,706,297 A * 11/1987 Ausnit ..... B65D 33/2508 383/122
6,722,784 B2 * 4/2004 Breil, Jr. ..... B65D 33/2533 383/86

(Continued)

FOREIGN PATENT DOCUMENTS

DE 202005011685 U1 11/2005
JP 3066786 U * 3/2000

(Continued)

OTHER PUBLICATIONS

JP 3066786 B2 Translation, Mar. 2000 (Year: 2000).*

(Continued)

*Primary Examiner* — Scott T McNurlen
*Assistant Examiner* — Matthew T Theis
(74) *Attorney, Agent, or Firm* — Pearne & Gordon LLP

(57) ABSTRACT

The application relates to a device for storing an article, including: a main part having a main part lower face, a main part top face opposite the main part lower face, and an outer face interconnecting the main part lower face and the main part top face, and a folding part which can be folded over the outer face of the main part when seen from the main part lower face towards the main part top face.

12 Claims, 8 Drawing Sheets

(56) References Cited

U.S. PATENT DOCUMENTS

| | | | | |
|---|---|---|---|---|
| 8,475,045 | B2 * | 7/2013 | Meyer | A45C 13/002 150/112 |
| 10,178,815 | B1 | 1/2019 | Fortune et al. | |
| 2009/0151826 | A1 * | 6/2009 | Baxter | A45C 1/024 150/118 |
| 2017/0119116 | A1 * | 5/2017 | Bradley | A45C 13/36 |

FOREIGN PATENT DOCUMENTS

| | | | | |
|---|---|---|---|---|
| JP | 2002136318 | A | * | 5/2002 |
| JP | 3166525 | U | * | 3/2011 |
| KR | 20180026819 | A | * | 3/2018 |

OTHER PUBLICATIONS

KR 20180026819 A Translation, OH, Mar. 2018 (Year: 2018).*
JP-3166525-U Translation, 伊藤　幸信, Mar. 10, 2011 (Year: 2011).*
JP 2002136318 A Translation, Hirose M, May 14, 2002 (Year: 2002).*
International Search Report from corresponding International Application No. PCT/IB2020/051680 mailed Apr. 28, 2020.
Written Opinion from corresponding International Application No. PCT/IB2020/051680 dated Apr. 28, 2020.
European Search Report from corresponding European Application No. 19020098.0 dated Jul. 4, 2019.

* cited by examiner

DEVICE FOR PROTECTING AN ARTICLE FROM MOISTURE

CROSS-REFERENCE TO RELATED APPLICATIONS

This is a National Stage application of PCT international application PCT/IB2020/051680 filed on Feb. 27, 2020, which claims the priority of European Patent Application No. 19020098.0, filed Feb. 28, 2019, which are incorporated herein by reference in their entireties.

FIELD OF THE INVENTION

The present invention relates to a device for storing an article.

BACKGROUND OF THE INVENTION

Such a device is known from DE 20 2005 011 685 U1. The object of the invention is to improve the known.

BRIEF SUMMARY OF THE INVENTION

According to one aspect of the invention, a device for storing an article comprises: a main body having a main body base face, a main body top face opposite the main body base face, and a lateral face connecting the main body base face and the main body top face; and a flexible folding tube which has a tube sleeve which is fastened at a tube base side to the main body base face such that the folding body can be pulled, by a tube top side opposite the tube base side, over the lateral face of the main body, as seen from the main body base face towards the main body top face.

The specified method is based on the consideration that it is already recognised in the device mentioned in the introduction that a device for storing an article must be water-tight for use during bathing. However, because water-tightness cannot be completely ensured, a visual inspection of the device mentioned in the introduction is made possible.

A different approach is taken with the specified device. It is designed with a folding body which can be pulled over an opening of an accommodation space in a main body. The pulling over means not only that the accommodation space can be effectively closed but also that a closure gap between the main body and the folding body, through which water could potentially penetrate, becomes much wider and longer. In this manner, the risk of undesired penetration of water into the accommodation space is noticeably reduced.

In an embodiment of the specified device, the main body is produced from a main body material which is harder than a folding body material from which the folding body is formed. In this manner, the folding body can be stretched over the main body, as a result of which the aforementioned closure gap is frictionally closed, and the risk of penetrating moisture is further reduced.

In a further embodiment of the specified device, the folding body is fastened to the main body in a circumferentially closed manner. In this manner, one side on the main body is already closed in a water-tight manner, and therefore water is already reliably prevented from penetrating at this point.

In another embodiment, the specified device comprises an accommodation space which is opened via an opening, and the folding body can be pulled at least over the opening in order to close the accommodation space. By means of the accommodation space and the opening connected thereto, the area over which moisture can reach the article to be stored is reduced, as a result of which the moisture protection is further improved.

In a preferred embodiment of the specified device, the accommodation space is formed in the main body with its opening on the lateral face. In this manner, the main body can be formed integrally with the accommodation space, which is advantageous from a production standpoint.

In a particular embodiment of the specified device, a closure mechanism is arranged on a side of the opening of the accommodation space opposite the fastening between the main body and the folding body, as seen from the opening of the accommodation space, said closure mechanism fixing the position of the folding body relative to the main body. Thanks to the closure mechanism, the risk of the penetration of water can also be further reduced at this point, which further increases the water-tightness of the specified device.

In an additional embodiment of the specified device, the closure mechanism has a first form-fitting element on the main body and a second form-fitting element on the folding body, the two form-fitting elements being designed to prevent a movement of the folding body counter to a folding direction. The design of the closure mechanism as a form fit means that the folding body can be hooked onto the main body to prevent it from unintentionally exposing the opening to the accommodation space.

In a preferred embodiment of the specified device, the first form-fitting element is a groove, and the second form-fitting element is a protrusion which engages in the groove. The design of the form-fitting elements as a groove and protrusion means that the aforementioned closure gap between the main body and the folding body is lengthened further, which further increases the water-tightness. For this reason, both the groove and the protrusion should expediently be formed running around the main body and the folding body, respectively.

In a particularly preferred embodiment of the specified device, the folding body tapers conically, as seen from a fastening point on the main body. The conical tapering means that the folding body pulled over the main body presses against the main body when it is pulled counter to the pulling-over direction. In this manner, the closure gap is closed further, and therefore In a further embodiment of the specified device, the opening to the accommodation space is formed on the lateral face of the main body in a depression extending into the main body, and the folding body has a peg element which can be inserted into the depression. The peg element engaging in the depression forms together with the depression the closure gap as a labyrinth gap and lengthens it further, thus improving the water-tightness.

In another embodiment of the specified device, the main body has blind holes directed into the main body on the main body top face. These blind holes ensure pressure equalisation when force is applied from different directions, so that the closure gap always remains securely closed. Water-tightness is thus ensured under different use conditions.

In an additional embodiment of the specified device, the blind holes are circular-segment-shaped or elliptical-segment-shaped in cross-section, the arc shape of the circular segment being directed into the interior of the main body. In this manner, the straight sections, opposite the arc shapes, of the circular-segment-shaped cross-sections are directed outwards and, when deformed by pressure from outside, are stretched as in an arc. The correspondingly occurring restoring force ensures that the main body reliably returns to its original shape.

In a particular embodiment of the specified device, the folding body tapers conically, as seen from a fastening point on the main body. In particular if the main body has a shortened design, so that the pulled-over folding body has to be fastened on a different substrate, such as the arm of its wearer, the areas of pressure are thus reduced, which improves wearing comfort.

In a preferred embodiment of the specified device, the folding body decreases in material thickness at least in some regions, as seen from a fastening point on the main body. In this manner, sufficient stretchability of the opening of the folding body for pulling over and at the same time sufficiently high overall stability can be ensured.

In a still further embodiment of the specified device, the folding body is elastic, at least on a side opposite the fastening to the main body. In this manner, the folding body pulled over the main body can be pressed elastically against the main body, and the closure gap can be closed more effectively. As a result, the water-tightness is thus increased further.

In a still further embodiment, the specified device comprises a through-opening running through the main body. This through-opening can optionally be separate from the accommodation space. A fastening element, such as a strap, can be fastened to this through-opening in a simple manner, with which fastening element the specified device can be fastened to the body and worn in a simple manner. If the through-opening is sufficiently large, a body part of the user, such as a leg or arm, can also be passed through.

BRIEF DESCRIPTION OF THE DRAWINGS

The above-described properties, features and advantages of this invention and the manner in which these are achieved become more understandable in conjunction with the following description of the exemplary embodiments, which are explained in more detail in conjunction with the drawing. In the figures.

Figure 1:
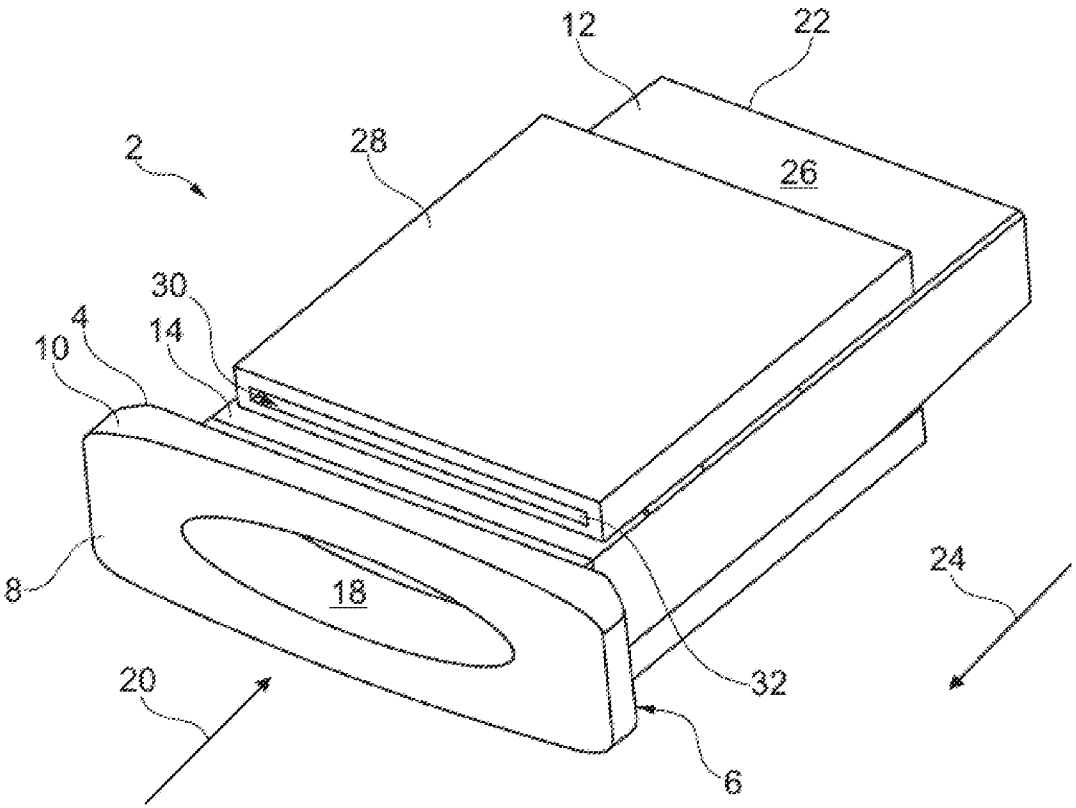
FIG. 1 shows a perspective view of a first embodiment of a device for storing an article.

In the drawings, the same technical elements are provided with the same reference signs and described only once. The drawings are purely schematic and in particular do not reproduce the actual geometric proportions.

DESCRIPTION OF EXAMPLE EMBODIMENTS

Figure 2:
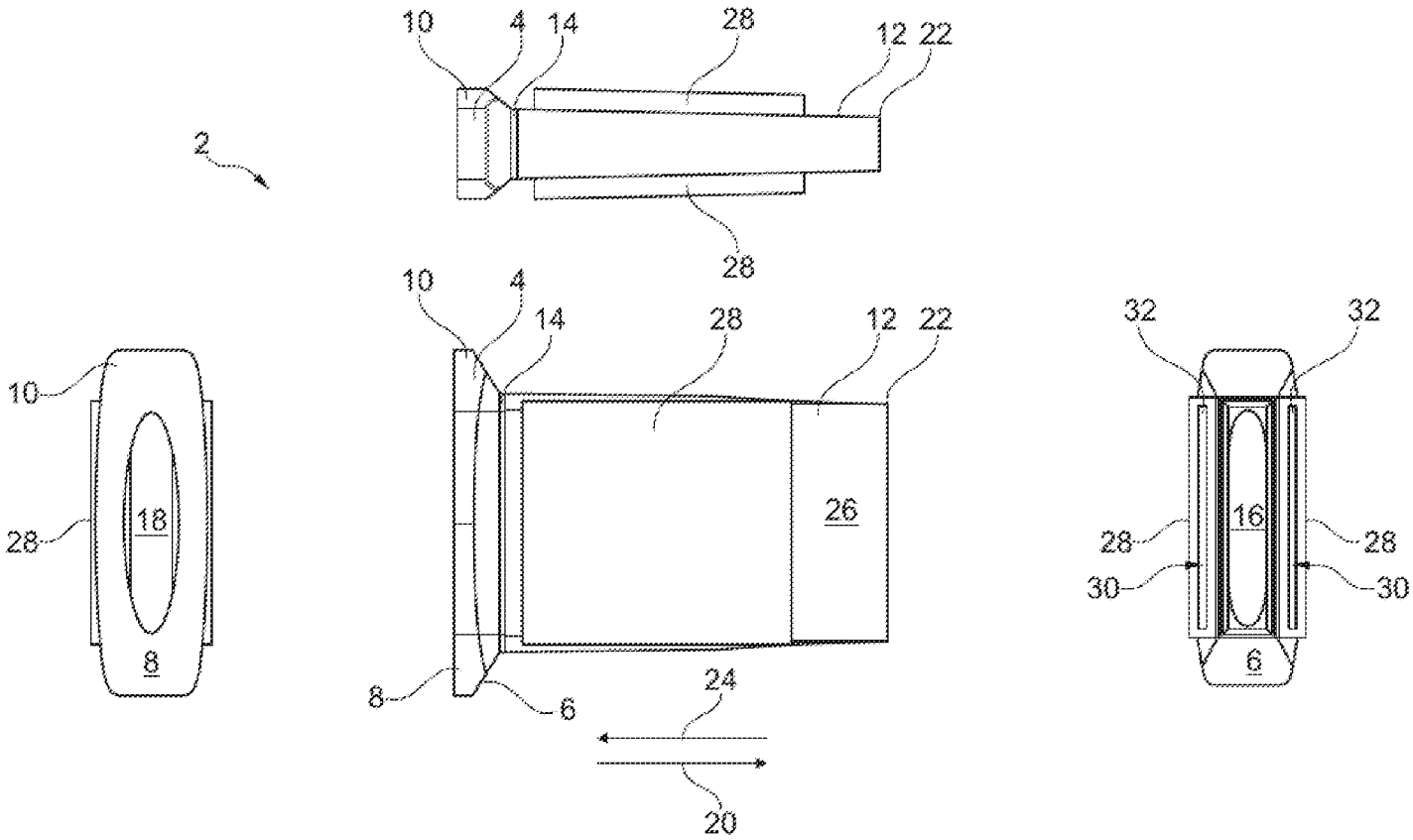
FIG. 2 shows a multi-sided view of the device of FIG. 1.
Figure 3:
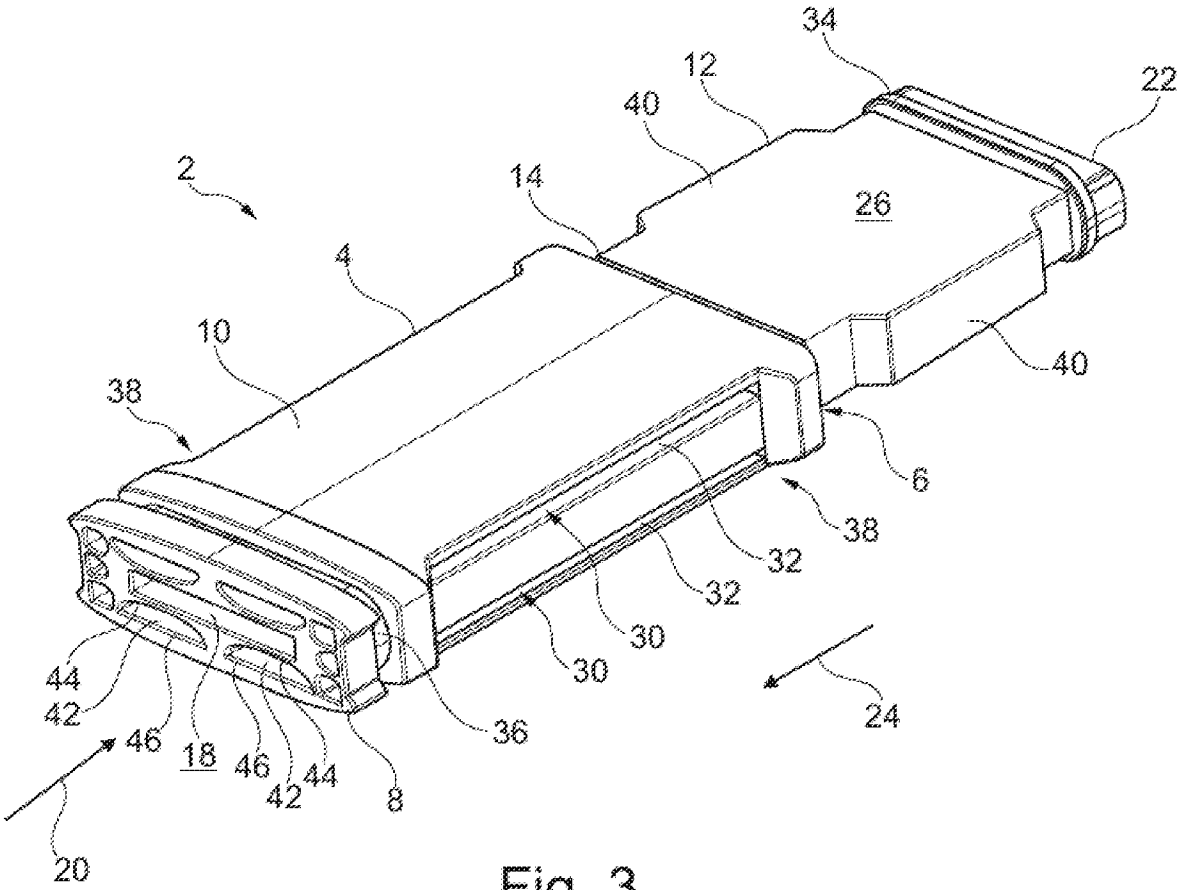
FIG. 3 shows a perspective view of a second embodiment of a device for storing an article.
Figure 4:
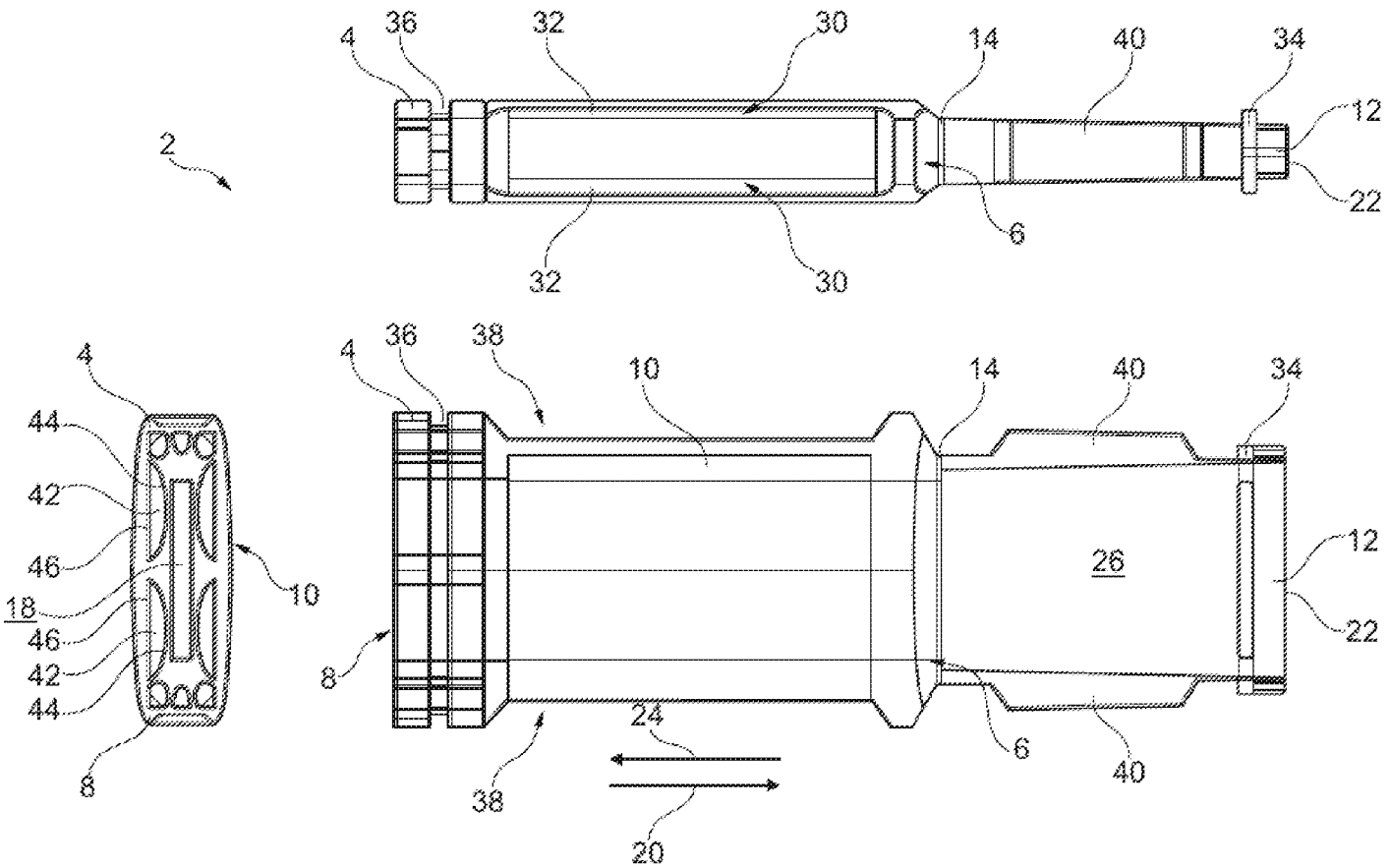
FIG. 4 shows a multi-sided view of the device of FIG. 3.

Reference is made to FIGS. 1 and 2, which show a device 2 for storing an article (not shown) according to a first exemplary embodiment.

The device 2 comprises a main body 4 having a main body base face 6, a main body top face 8 opposite the main body base face 6, and a lateral face 10 connecting the main body base face 6 and the main body top face 8. Adjoining the main body 4 there is a folding body 12, which is fastened by a fastened end 14 to the main body base face 6 of the main body 4 in a manner running around the latter. The fastening can be of any desired type. For example, the main body 4 and the folding body 12 can be formed integrally, so that the fastening is provided intrinsically by the structure. If the two parts 4, 12 are separate from each other, the folding body 12 can be fused to the main body 4, for example.

The folding body 12 is tubular and has a through-opening 16, which can be seen in FIG. 2. The main body 4 has a hole 18 analogous to the through-opening 16. In the assembled state, the through-opening 16 and the hole 18 are oriented concentrically with each other, so that, with corresponding dimensioning, an article or a body part of a user, such as an arm, can be introduced in an introduction direction 20 through the hole 18 and the through-opening 16.

In this state, the user can grasp a folding end 22 of the folding body 12, opposite the fastened end 14 of the folding body 12, and turn it inside out or fold it over in a folding direction 24 counter to the introduction direction 20 and then pull it over the main body 4. In this manner, the surface 26 of the folding body 12 which can be seen in FIG. 1 is rolled down so that the article (not visible) can be held stored for example between the arm of the user and the surface 26 which can be seen in FIG. 1.

For a defined position of the article to be stored, a housing 28 with an accommodation space 30 formed therein can optionally be held on the surface 26. In the present embodiment, two housings 28 are arranged and therefore correspondingly more accommodation spaces 30 for holding multiple articles are formed. The article, such as a credit card, can then be introduced into the corresponding accommodation space 30 via an opening 32 at each accommodation space 30.

Both the main body 4 and the folding body 12 can be produced from a flexible material. In this case, however, the folding body 12 should be made softer than the main body 4. Silicone is suitable as the material for both bodies 4, 12. However, the main body 4 should then be made more solid than the folding body 12.

As can be seen in the multi-sided view of FIG. 2, the folding body 12 can taper conically in one region. In particular in the embodiment of FIGS. 1 and 2, this has the advantage that, when the folding body 12 presses for example on the arm of the user when turned inside out, the arm is not compressed over its entire area by the folding body 12 but only at the point of the folding end 22 at which the conical tip is situated.

FIG. 3 to 6 show a further embodiment of the device 2 for storing an article. In this device 2, the main body 4 is elongate and extends at least over the entire length of the folding body 12, as seen in the folding direction 24. This has the advantage that the folding body 12, when turned inside out, does not press directly against the arm of the user but against the main body 4, when the device 2 is used in this manner. The folding body 12 is thus prevented from pinching the arm of the user.

The folding body 12 has, at its folding end 22, a form-fitting element in the form of a protrusion 34 running around the folding body 12. If the folding body 12 is folded over around the fastened end 14 on the main body base face 6 of the main body 4, the protrusion 34 can be inserted into a corresponding further form-fitting element in the form of a groove 36 running around the main body 4. Thanks to the form fit between these two form-fitting elements 34, 36, not only is the folding end 22 of the folding body 12 is fixed in position in and counter to the folding direction 24, but also the penetration distance for liquid between the folding body 12 and the main body 4 is thus lengthened, which further increases protection from moisture.

The accommodation spaces 30 are integrated in the main body 4 in the present embodiment. The entire device 2 can thus be formed integrally, for example by an injection-moulding process. In this case, the main body has, in the region of the openings 32 of the accommodation spaces 30, depressions 38, into each of which a peg element 40 arranged on the folding body 12 can engage when the folding body 12 is pulled over the main body 4 in the above-described manner. The peg elements 40 and the corresponding depressions 38 further lengthen the penetration distance for moisture to the accommodation spaces 30, and therefore the articles accommodated therein are even better protected from moisture.

The peg elements 40 can also be concave or recessed on their side opposite the visible surface 26 of the folding body 12. In this manner, it is possible to grip the device 2 well with two fingers and, for example, pull it over the arm of the user, even in a state in which the folding body 12 is pulled over the main body 4.

Finally, blind holes 42 can be formed in the main body top face of the main body 4 and be directed therein. In the present embodiment, these blind holes 42 are circular-segment-shaped and each have an arc section 44 and a chord section 46. For the sake of clarity, not all the blind holes 42 and the elements thereof have been provided with their own reference signs in the drawings.

The arc sections 44 tension the chord sections 46. If a force acts from outside on the lateral face 10 of the main body 4 in the region of the top face 8 and deforms the main body 4 at this point, the arc sections 44 ensure, by means of their tensioning force, that the chord sections 46 are oriented straight again. In this manner, the main body 4 remains dimensionally stable, and a closure gap (not shown in the drawings) between the inside-out folding body 12 and the main body 4 is always minimal.

Figure 5:
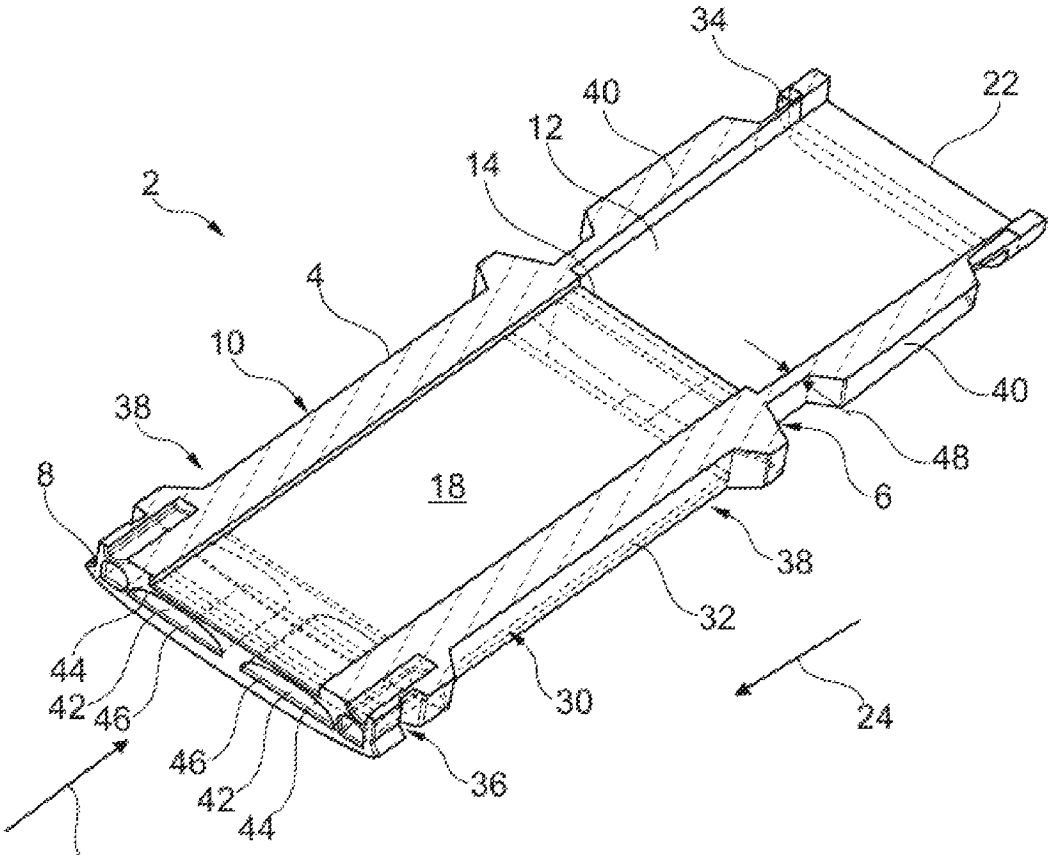
FIG. 5 shows a perspective view of the device of FIG. 3, which is cut open through a first sectional plane.
Figure 6:
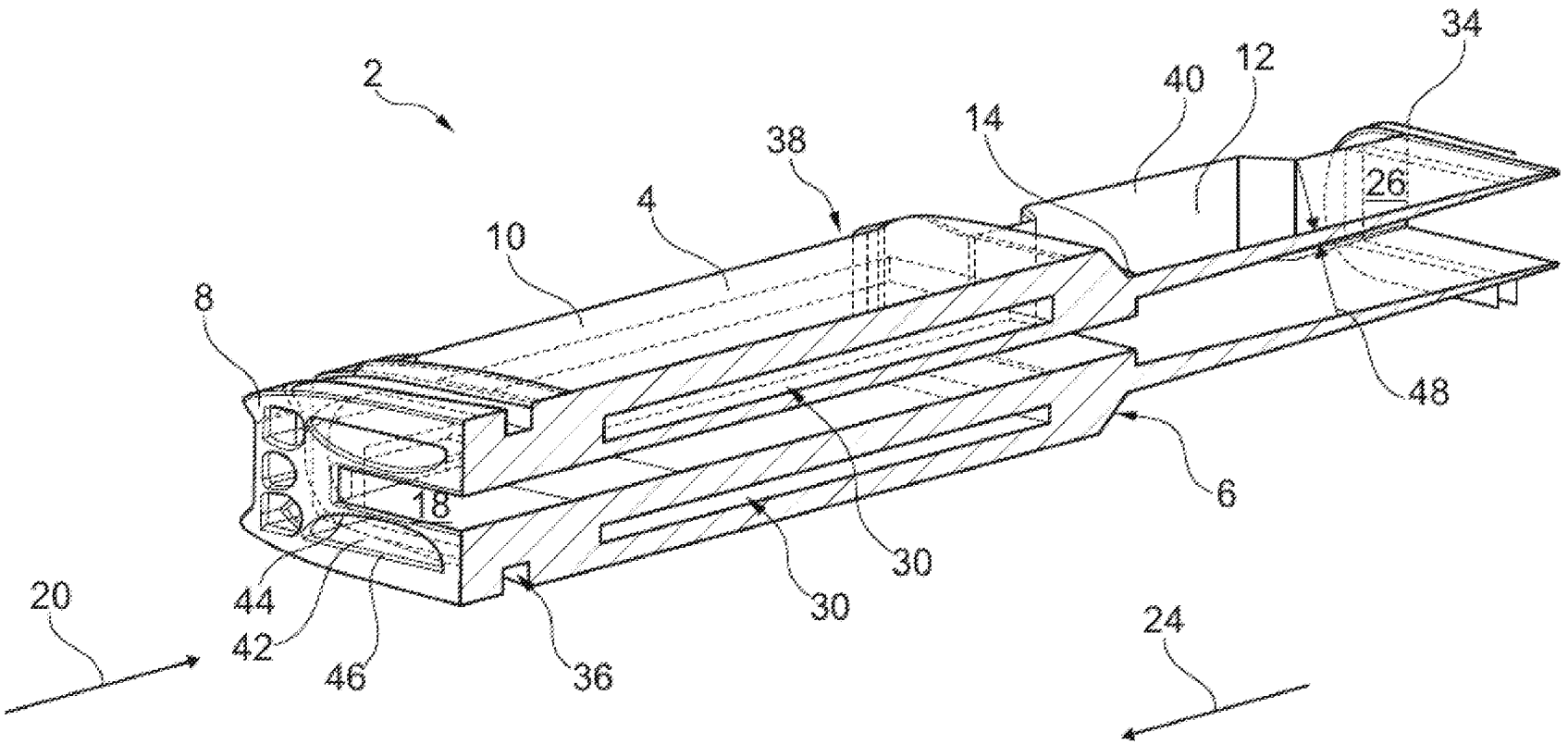
FIG. 6 shows a perspective view of the device of FIG. 3, which is cut open through a second sectional plane.

As can be seen in FIGS. 5 and 6, a wall thickness 48 of the folding body 12 can decrease at least in some sections counter to the folding direction 24.

Figure 7:
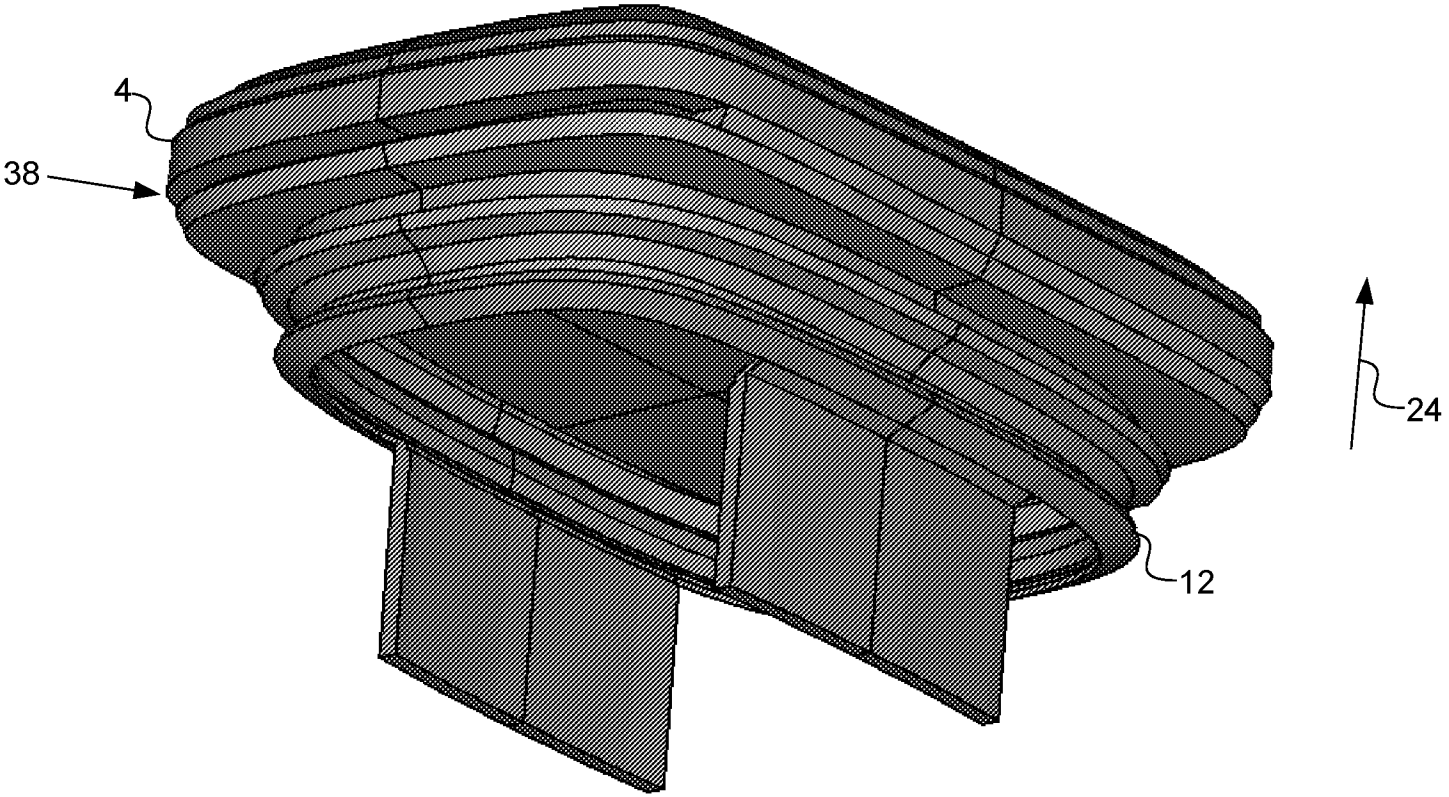
FIG. 7 shows a perspective view of a third embodiment of a device for storing an article in a first state.
Figure 8:
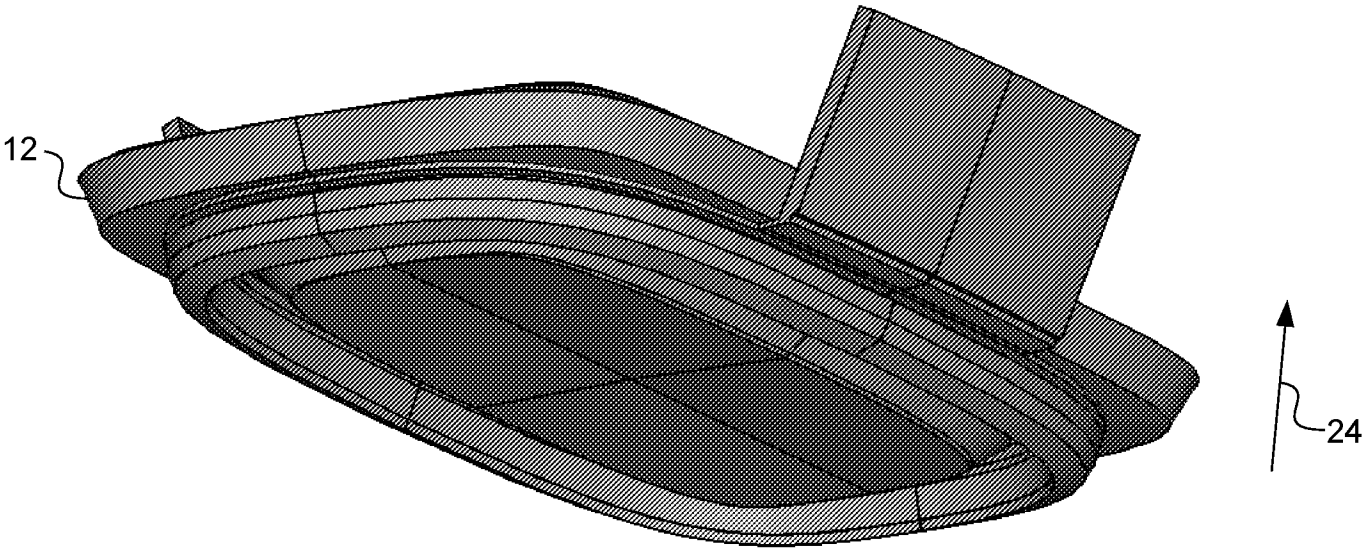
FIG. 8 shows a perspective view of the third embodiment of the device for storing an article in a second state.

FIGS. 7 and 8 show a third perspective view of a third embodiment of the device 2 for storing an article in two different states and are intended to illustrate that the folding direction 24 can be chosen as desired.

The invention claimed is:

1. A device for storing an article in a water-tight manner for use during bathing, comprising:

a main body having a main body base face, a main body top face opposite the main body base face, and a lateral face connecting the main body base face and the main body top face, a flexible folding body which has a tube sleeve which is fastened at a tube base side to the main body base face, and an accommodation space which is accessible via an opening, wherein the accommodation space is formed in the main body with its opening on the lateral face, wherein the folding body can be pulled at least over the opening in order to close the accommodation space, wherein the folding body is configured to be pulled, by a tube top side opposite the tube base side, over the main body base face, and then over the lateral face of the main body towards the main body top face, wherein the folding body tightly encloses the main body in order to seal the opening, wherein a closure mechanism is arranged on a side of the opening of the accommodation space opposite the fastening between the main body and the folding body, as seen from the opening of the accommodation space, said closure mechanism fixing the position of the folding body relative to the main body when the folding body is pulled over the main body and tightly encloses the main body, and wherein the closure mechanism has a first form-fitting element on the main body and a second form-fitting element on the folding body, and wherein the two form-fitting elements are designed to prevent a movement of the folding body counter to a folding direction.

2. The device according to claim 1, wherein the main body is produced from a main body material which is harder than a folding body material from which the folding body is formed.

3. The device according to claim 1, wherein the folding body is fastened to the main body in a circumferentially closed manner.

4. The device according to claim 1, wherein the first form-fitting element is a groove, and the second form-fitting element is a protrusion which engages in the groove.

5. The device according to claim 1, wherein the opening to the accommodation space is formed on the lateral face of the main body in a depression extending into the main body, and wherein the folding body has a peg element which can be inserted into the depression.

6. The device according to claim 1, wherein the main body has blind holes directed into the main body on the main body top face.

7. The device according to claim 6, wherein the blind holes are circular-segment-shaped or elliptical-segment-shaped in cross-section, wherein the arc shape or ellipse shape of the circular segment is directed into the interior of the main body.

8. The device according to claim 1, wherein the folding body tapers conically at least in some regions, as seen from a fastening point on the main body.

9. The device according to claim 1, wherein the folding body decreases in material thickness at least in some regions, as seen from a fastening point on the main body.

10. The device according to claim 1, wherein the folding body is elastic, at least on a side opposite the fastening to the main body.

11. The device according to claim 1, comprising a through-opening running through the main body.

12. The device according to claim 1, wherein the folding body is configured to cover the opening of the accommodation space by pulling the tube top side of the folding body in a folding direction until the folding body covers the opening, wherein the folding direction extends from the main body base face towards the main body top face.

* * * * *